US012232554B2

(12) United States Patent
Cooper et al.

(10) Patent No.: US 12,232,554 B2
(45) Date of Patent: Feb. 25, 2025

(54) HELMET WITH A BARRIER FEATURE

(71) Applicant: Defender Safety, Inc., Plainview, NY (US)

(72) Inventors: Dylan Maynard Cooper, Carterton (NZ); George Alexis Hugo, Durbanville (ZA); Stephan Le Roux, Durbanville (ZA)

(73) Assignee: Defender Safety, Inc., Plainview, NY (US)

( * ) Notice: Subject to any disclaimer, the term of this patent is extended or adjusted under 35 U.S.C. 154(b) by 113 days.

(21) Appl. No.: 18/161,959

(22) Filed: Jan. 31, 2023

(65) Prior Publication Data

US 2024/0049826 A1 Feb. 15, 2024

Related U.S. Application Data

(63) Continuation of application No. 29/849,827, filed on Aug. 15, 2022, and a continuation of application No. 29/865,796, filed on Aug. 12, 2022.

(51) Int. Cl.

| | |
|---|---|
| ***A42B 3/06*** | (2006.01) |
| ***A42B 3/08*** | (2006.01) |
| ***A42B 3/28*** | (2006.01) |

(52) U.S. Cl.

CPC ..... *A42B 3/06* (2013.01); *A42B 3/08* (2013.01); *A42B 3/28* (2013.01)

(58) Field of Classification Search

CPC .... A42B 3/06; A42B 3/08; A42B 3/28; A42B 3/14

See application file for complete search history.

(56) References Cited

U.S. PATENT DOCUMENTS

| | | | | | |
|---|---|---|---|---|---|
| 3,387,304 | A * | 6/1968 | Simpson | A42B 3/14 | 2/419 |
| 5,898,949 | A * | 5/1999 | Barthold | A42B 3/10 | 2/5 |
| 6,032,297 | A * | 3/2000 | Barthold | A42B 3/10 | 2/418 |
| 6,081,931 | A * | 7/2000 | Burns | A42B 3/14 | 2/416 |
| 2010/0043126 | A1* | 2/2010 | Morel | A42B 3/32 | 2/421 |
| 2010/0281603 | A1* | 11/2010 | Ho | A42B 3/08 | 2/421 |
| 2014/0109301 | A1* | 4/2014 | Hall | A42B 3/142 | 2/416 |
| 2015/0250248 | A1* | 9/2015 | Jacobsen | A42B 3/08 | 2/421 |
| 2016/0192727 | A1* | 7/2016 | Hall | A42B 3/14 | 2/416 |
| 2018/0325204 | A1* | 11/2018 | Jacobsen | A42B 3/128 | |
| 2021/0037905 | A1* | 2/2021 | Ward | A42B 3/14 | |
| 2023/0180877 | A1* | 6/2023 | Brouwer | A42B 3/06 | 2/419 |
| 2024/0081459 | A1* | 3/2024 | Worple | A42B 3/128 | |

* cited by examiner

*Primary Examiner* — Khaled Annis
(74) *Attorney, Agent, or Firm* — Tutunjian & Bitetto, P.C.

(57) ABSTRACT

A helmet includes an outer shell, an inner shell molded within the outer shell, the inner shell supporting a cap with straps and having a barrier wall, and at least one suspension clip coupled to the cap and releasably attached to the barrier wall, the barrier wall separating a distal end of the at least one suspension clip into two components, the two components having a first connecting member and a second connecting member.

18 Claims, 9 Drawing Sheets

HELMET WITH A BARRIER FEATURE

FIELD OF INVENTION

The present invention relates generally to personal head protection devices, and more specifically, to a safety helmet with a barrier feature.

BACKGROUND

Safety helmets are often used in construction or other environments/worksites where head protection is warranted. For example, safety helmets are used in environments where there is a risk for head injury and act to provide added protection to a worker's head.

Safety helmets and helmets protect the wearer from hazards that impact the head. They have a suspension system that moves the impact force though the body to feet, helping to reduce strain to the head, neck, and spine. These safety helmets are ANSI rated and OSHA compliant. Types and classes combine to indicate the impact type (vertical only or vertical and angled) and level of electrical protection (none, low voltage, or high voltage) provided. Safety helmets should be inspected regularly for structural integrity. Safety helmets are used by construction workers, road crews, or where required by OSHA safety regulations.

SUMMARY

In accordance with an embodiment, a helmet is provided. The helmet includes an outer shell, an inner shell molded within the outer shell, the inner shell supporting a cap with straps and having a barrier wall, and at least one suspension clip coupled to the cap and releasably attached to the barrier wall, the barrier wall separating a distal end of the at least one suspension clip into two components, the two components having a first connecting member and a second connecting member.

In accordance with another embodiment, a helmet is provided. The helmet includes an outer shell, an inner shell positioned within the outer shell to support a cap with straps, and at least one suspension clip having a first connecting member and a second connecting member, the first and second connecting members releasably attached to a barrier wall disposed on the inner shell such that the barrier wall prevents electrical conduction between the first and second connecting members.

It should be noted that the exemplary embodiments are described with reference to different subject-matters. In particular, some embodiments are described with reference to method type claims whereas other embodiments have been described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be described within this document.

These and other features and advantages will become apparent from the following detailed description of illustrative embodiments thereof, which is to be read in conduction with the accompanying drawings.

BRIEF DESCRIPTION OF THE DRAWINGS

The invention will provide details in the following description of preferred embodiments with reference to the following figures wherein.

Throughout the drawings, same or similar reference numerals represent the same or similar elements.

DETAILED DESCRIPTION

Figure 1:
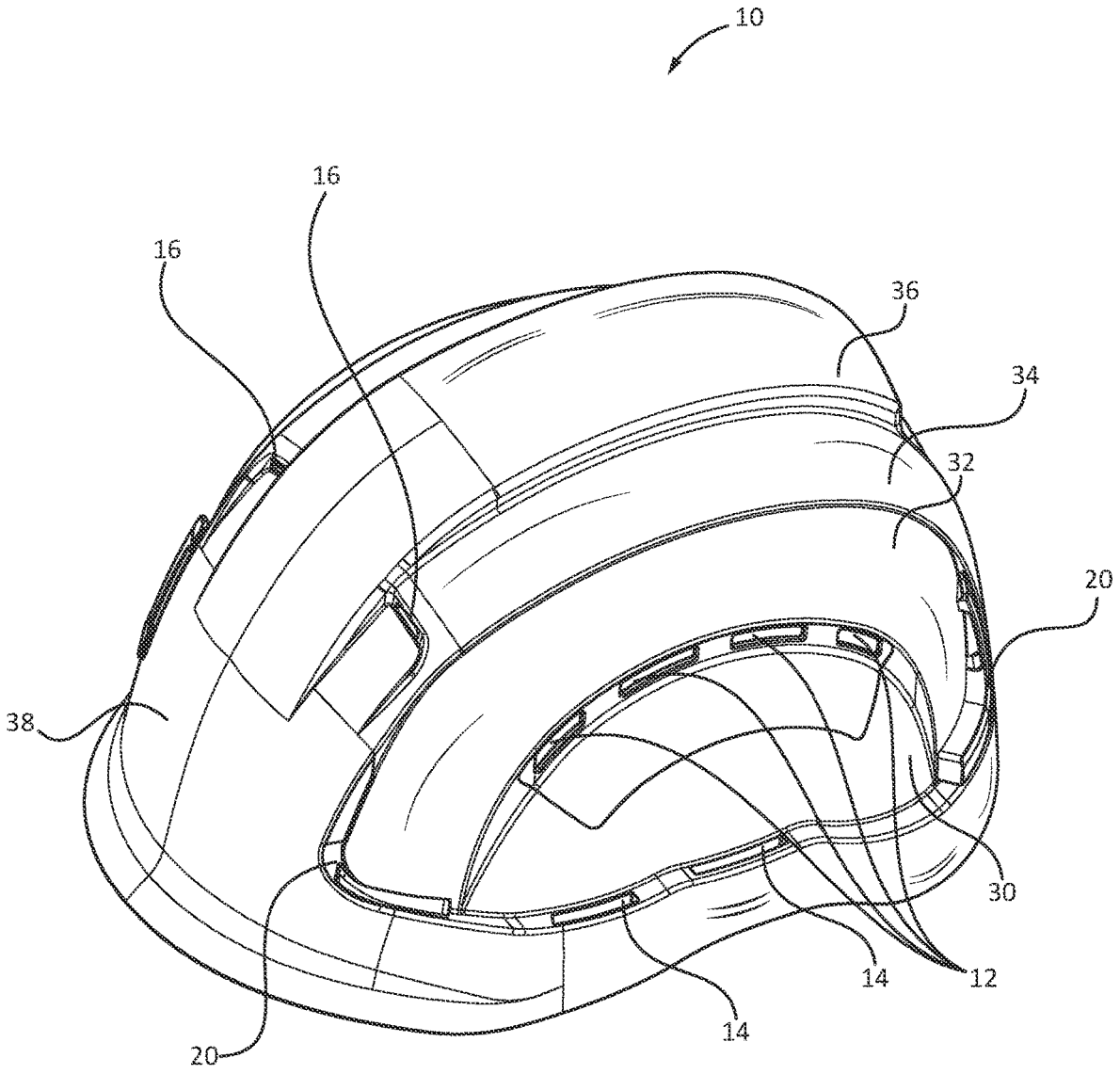
FIG. 1 is a perspective view of a helmet, in accordance with an embodiment of the present invention.

Embodiments in accordance with the present invention provide for a helmet with a barrier feature. The barrier feature separates a distal end of a suspension clip such that the suspension clip need not be material dependent to satisfy Class E safety helmet requirements.

Type I safety helmets offer protection to the top of the head, whereas Type II safety helmets offer protection to the top and sides of the head. There are three types of safety helmet classes, that is, Class C helmets, Class G helmets, and Class E helmets. Class C helmets are conductive helmets that do not offer electrical protection, Class E helmets are general safety helmets rated for 2,200 volts, and Class E helmets are electrical safety helmets rated for 20,000 volts.

Class E (Electrical) safety helmets are designed to reduce exposure to high voltage conductors, and offer dielectric protection up to 20,000 volts (phase to ground).

Side- and top-protecting full-brim safety helmets (Type 2, Class E) are used where swinging objects such as hooks and chains pose a hazard. They have a full brim around the entire hat to reduce glare and help shade the eyes, face, and neck in bright sunlight. Type 2 safety helmets provide protection against vertical and angled impacts up to 60°. They have more padding than Type 1 safety helmets, which generally makes them more bulky and heavier. They are rated Class E for high-voltage electrical protection up to 20 KV. Type 2 helmets should be worn when indicated by OSHA or where swinging objects (such as hooks or chains) are a concern.

Vented full-brim (Type 1, Class E) safety helmets are vented to help dissipate heat and have a brim around the entire hat to shed rain, reduce glare, and protect the face and neck from the sun. Type 1 safety helmets protect wearers from vertical impacts. They are rated Class E for high-voltage electrical protection up to 20 KV. Full-brim safety helmets provide additional protection outdoors where the sun is harsh.

Work-at-height climbing helmets (Type 2, Class E) have a chinstrap that keeps the helmet in place if a fall or impact occurs, and enclose the back and sides of the head, for extra protection. Type 2 helmets provide protection against vertical and angled impacts up to 60°. They have more padding than Type 1 helmets, which generally makes them more bulky and heavier. They are rated Class E for high-voltage electrical protection up to 20 KV. Type 2 helmets should be worn when indicated by OSHA or where swinging objects (such as hooks or chains) are a concern.

With regards to Class E safety helmets, the suspension clips are material dependent to meet the requirements of electrical safety helmets to prevent electrical conduction or electrical transmission. To alleviate the aforementioned material dependency issue, the exemplary embodiments of the present invention introduce a helmet with a barrier feature, such as a barrier wall molded or being a part of the interior of the safety helmet. The barrier feature or barrier wall separates the distal end of the suspension clip such that the suspension clip is no longer material dependent to satisfy Class E safety helmet requirements. The separation results in two components or elements of the suspension clip that do not touch each other and do not engage each other because the barrier wall operates to prevent them from touching or engaging each other to prevent electrical conduction or transmission therebetween.

It is to be understood that the present invention will be described in terms of a given illustrative architecture; however, other architectures, structures, substrate materials and process features and steps/blocks can be varied within the scope of the present invention. It should be noted that certain features cannot be shown in all figures for the sake of clarity. This is not intended to be interpreted as a limitation of any particular embodiment, or illustration, or scope of the claims.

Figure 4:
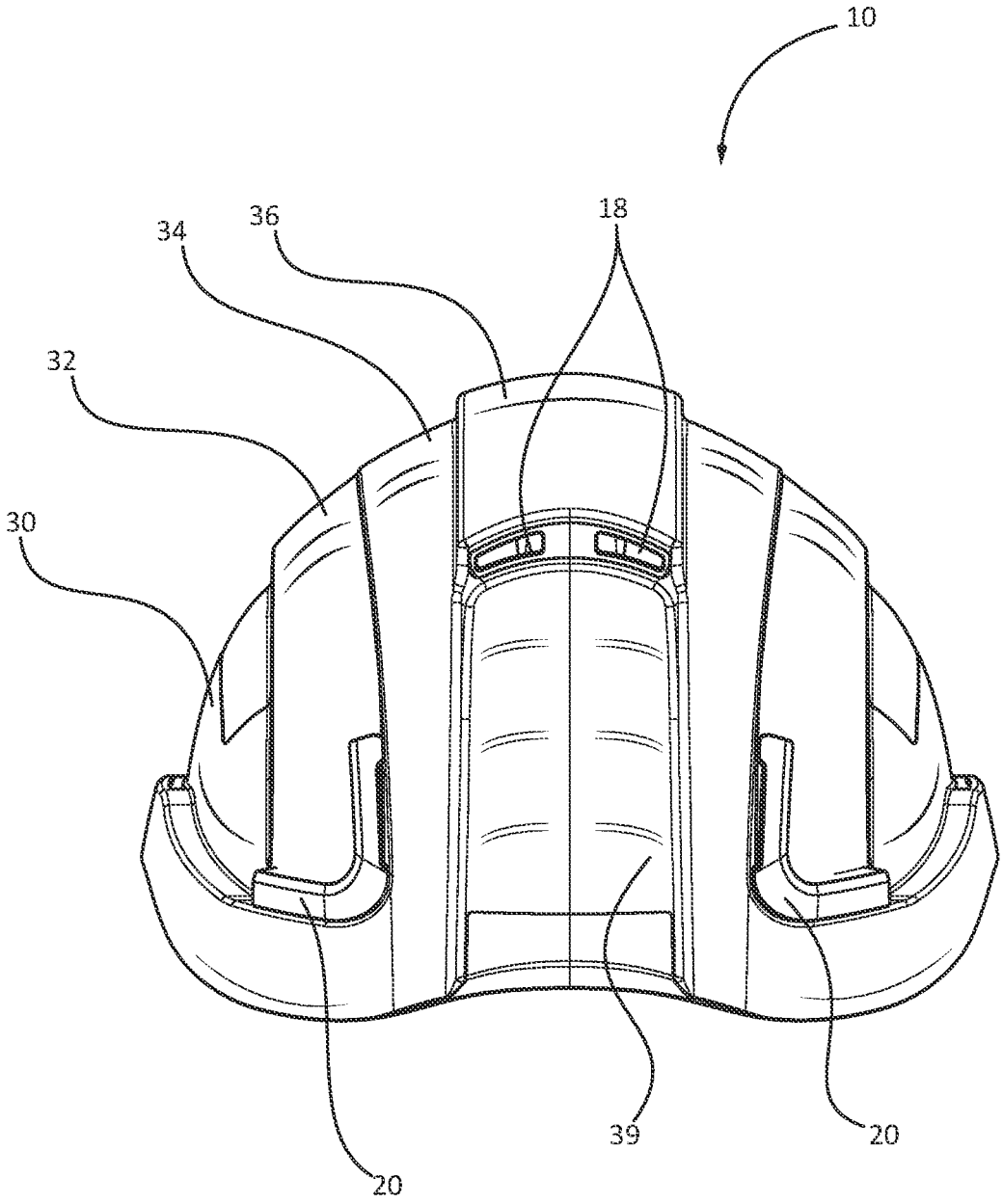
FIG. 4 is a back view of the helmet of FIG. 1, in accordance with an embodiment of the present invention.

FIG. 1 is a perspective view of a helmet, in accordance with an embodiment of the present invention. The helmet 10 includes a first set of vents 12, a second set of vents 14, a third set of vents 16, and a fourth set of vents 18 (FIG. 4). The third set of vents 16 are front vents and the fourth set of vents 18 are back vents. The first set of vents 12 and the second set of vents 14 are side vents.

The helmet 10 defines a side face 30 and a front face 38. The helmet 10 further defines a first rib 32 and a second rib 34. The first rib 32 is adjacent the second rib 34.

The helmet 10 also has an outer shell 36.

Figure 3:
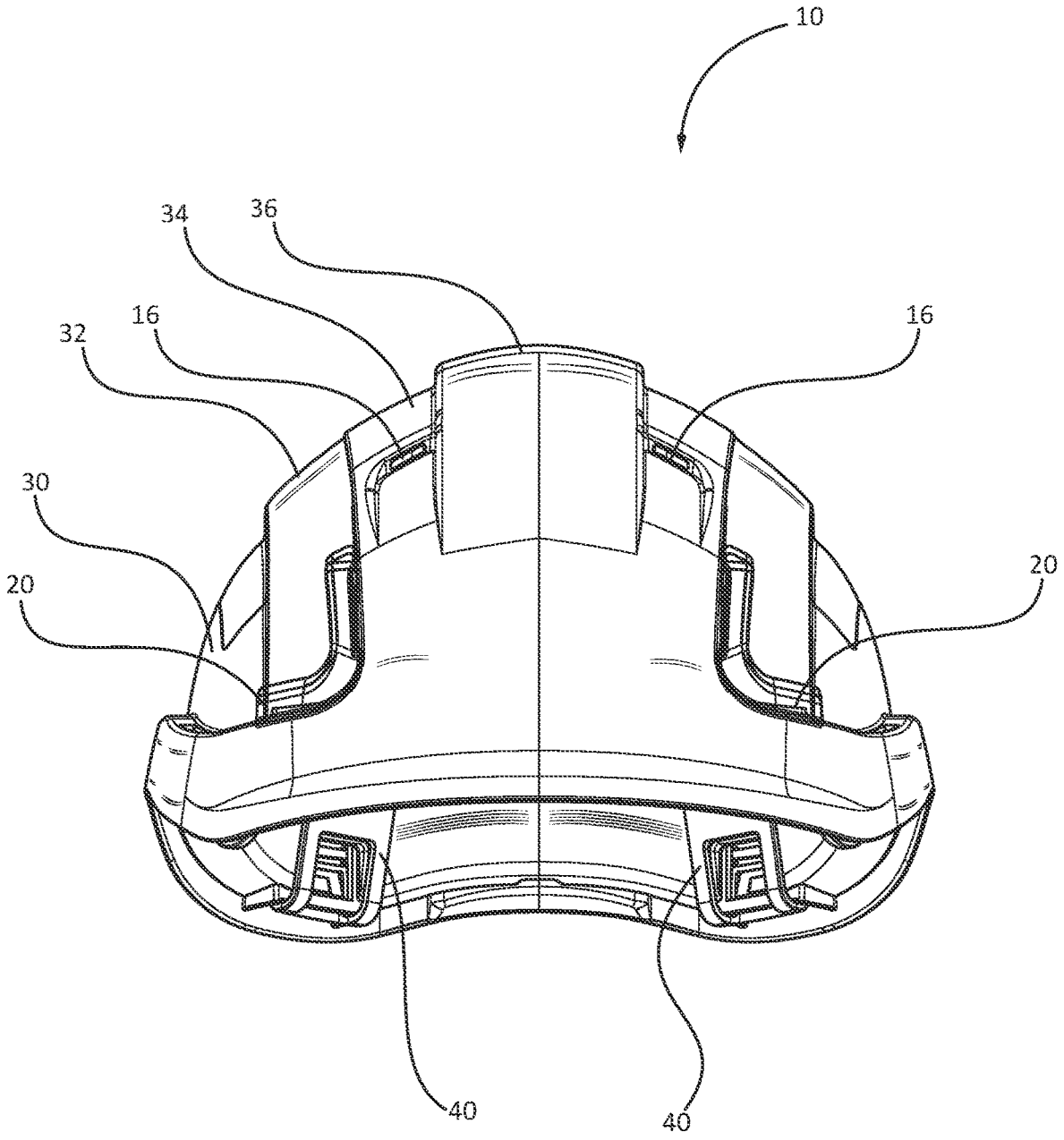
FIG. 3 is a front view of the helmet of FIG. 1, in accordance with an embodiment of the present invention.

The helmet 10 further includes an outer portion 20 of a suspension clip 40 (FIG. 3). The outer portion 20 of the suspension clip 40 is located on opposed ends of the first rib 32. The outer portion 20 of the suspension clip 40 is located between the first set of vents 12 and the second set of vents 14.

Figure 2:
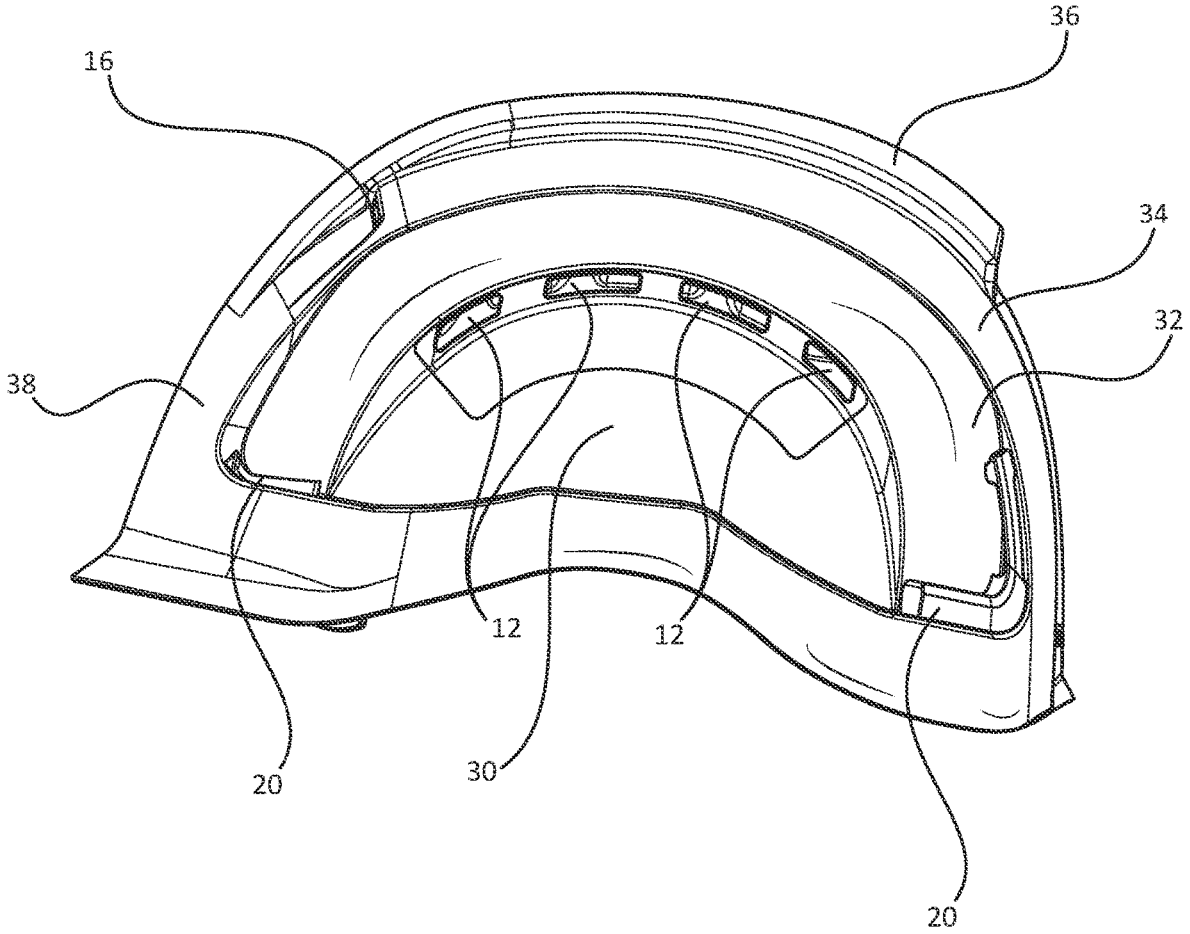
FIG. 2 is a side view of the helmet of FIG. 1, in accordance with an embodiment of the present invention.

FIG. 2 is a side view of the helmet of FIG. 1, in accordance with an embodiment of the present invention. The side view further shows the outer portion 20 of the suspension clip 40 located on opposed ends of the first rib 32, as well as the first set of vents 12.

FIG. 3 is a front view of the helmet of FIG. 1, in accordance with an embodiment of the present invention. The front view better shows the suspension clips 40.

FIG. 4 is a back view of the helmet of FIG. 1, in accordance with an embodiment of the present invention. The back view shows the back face 39 of the helmet 10, as well as the fourth set of vents 18. The outer portion 20 of the suspension clip 40 located on opposed ends of the first rib 32 are also shown.

Figure 5:
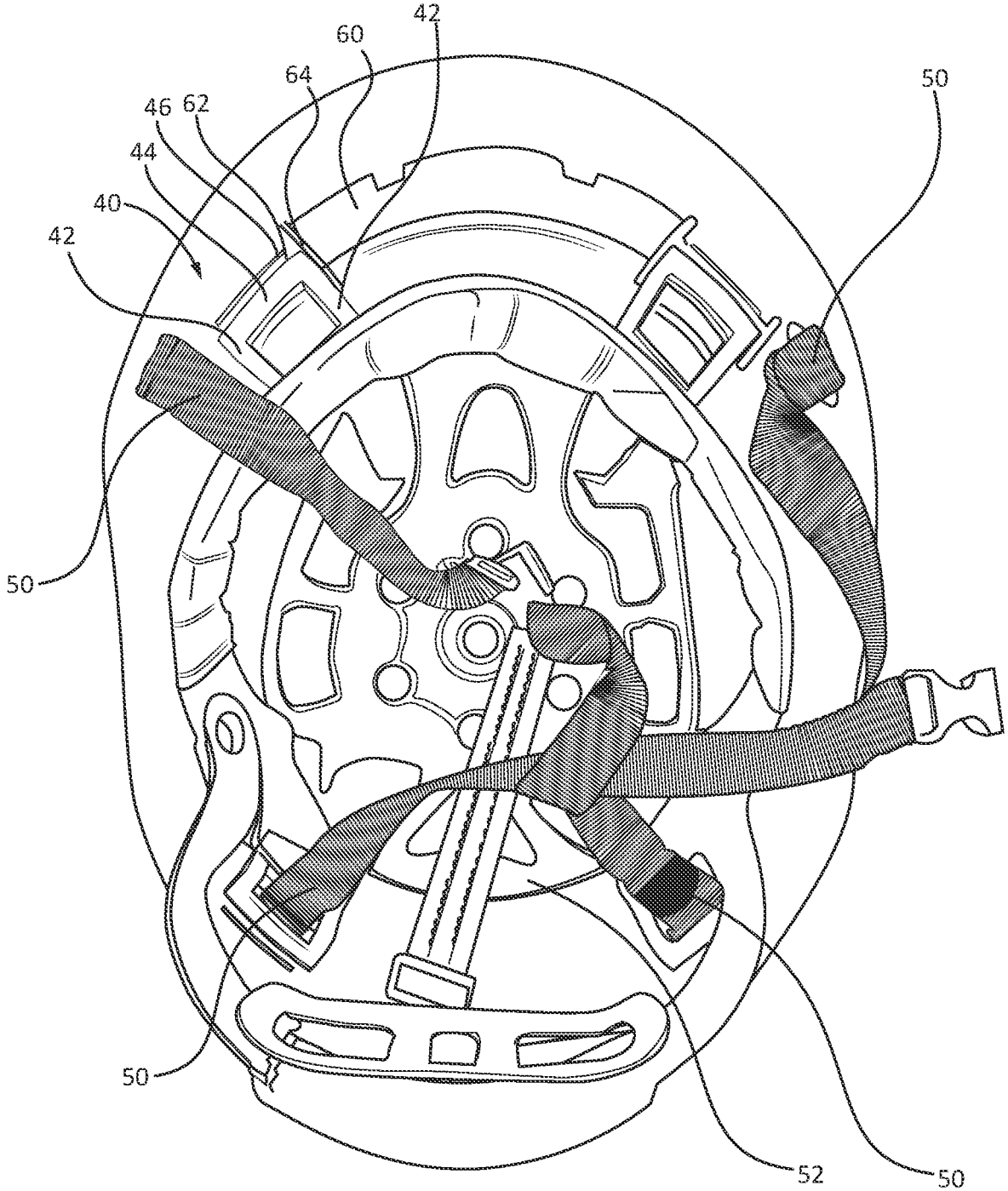
FIG. 5 is an bottom view of the helmet of FIG. 1, in accordance with an embodiment of the present invention.

FIG. 5 is an bottom view of the helmet of FIG. 1, in accordance with an embodiment of the present invention. The bottom view shows a cap 52 having a plurality of straps 50. In this exemplary embodiment, four straps 50 are shown. The cap 52 is of a size that can be adjusted to the head of a wearer.

The bottom view also shows the suspension clip 40 including legs 42 extending to a first connecting member 44. A second connecting member 46 is also shown such that a barrier 62 is positioned directly between the first connecting member 44 and the second connecting member 46. The first and second connecting members 44 and 46, respectively, can also be referred to as segments or components or elements. The barrier 62 defines barrier sidewalls 64. The barrier 62 will be discussed in further detail in FIGS. 6 and 7.

An inner shell 60 of the helmet 10 is also shown. The barriers 62 are part of the inner shell 60. The inner shell 60 can include a plurality of barriers 62. In one example, there are four barriers 62 for accommodating four straps 50 of the cap 52. However, one skilled in the art can contemplate any number of barriers 62 (or barrier walls) without departing from the spirit of the present invention.

Figure 6:
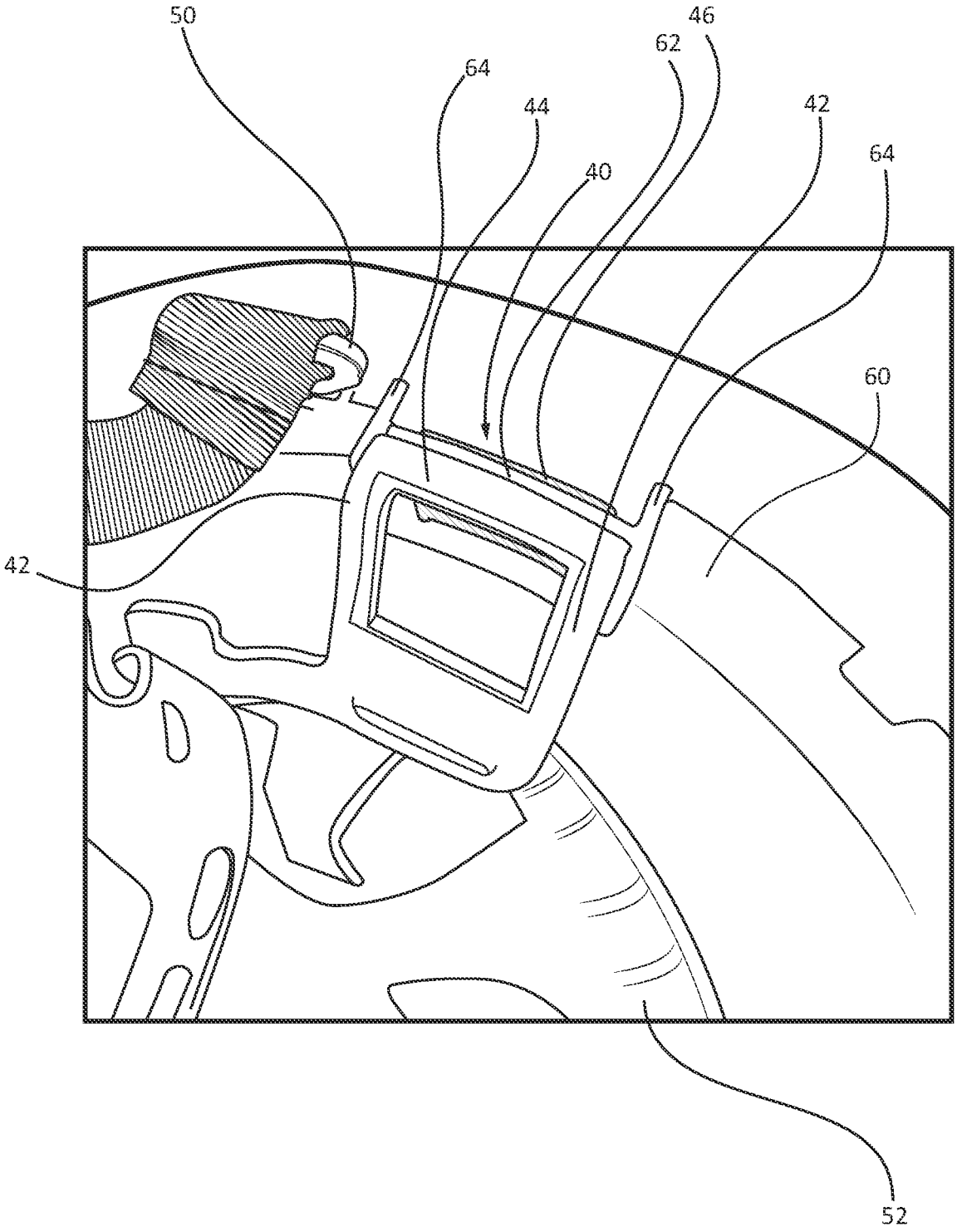
FIG. 6 is a side perspective view of the barrier feature of the helmet of FIG. 1, in accordance with an embodiment of the present invention.

FIG. 6 shows a side perspective view of the barrier feature of the helmet of FIG. 1, in accordance with an embodiment of the present invention.

The enlarged view of suspension clip 40 shows the legs 42 extending to the first connecting member 44. The second connecting member 46 is also shown in opposed relation to the first connecting member 44. Directly between the first connecting member 44 and the second connecting member 46 is the barrier 62. The first connecting member 44 and the second connecting member 46 are thus configured to be received on opposed ends of the barrier 62. The barrier 62 can also be referred to as a barrier wall or a barrier feature.

The barrier 62 acts as an electrical wall or electrical insulator that operates to prevent the distal end of the suspension clip 40 from being a continuous or uniform component. In other words, the distal end of the suspension clip 40 is split or divided into two distal pieces or components that are separated or disconnected or insulated by the barrier 62. The barrier 62 thus acts to break the electrical conduction at the distal end of the suspension clip 40. Stated differently, conduction of current is prevented between the first and second connecting members 44 and 46, respectively, by the barrier 62. The barrier 62 may be flush in height with the first and second connecting members 44 and 46, respectively. In other exemplary embodiments, the barrier 62 may have a height that is greater than the height of the first and second connecting members 44 and 46, respectively.

The barrier 62 further defines sidewalls 64 that are adjacent the inner shell 60. The barrier 62 and the sidewalls 64 of the barrier 62 can be constructed from the same material as the inner shell 60. The barrier 62 is thus a part of the inner shell 60.

In conventional suspension clip configurations, the suspension clip is one continuous component (or unbroken component) constructed from a material that resists or repels electricity. In other words, in conventional suspension clip configurations, the suspension clip is material dependent. However, as time goes on, the materials of the conventional suspension clip configurations can break down due to, e.g., wear and tear, and not function properly in completely resisting or repelling electricity (preventing electrical transmission). Thus, as the conventional suspension clip configurations break down, from a material point of view, they may potentially allow for some electrical conduction, which could be dangerous to the user of the helmet.

In contrast, the suspension clip 40 of the exemplary embodiments is not material dependent. Instead, the distal end of the suspension clip 40 is split or divided into two distal pieces or components that are separated or disconnected or insulated by the barrier 62, and can be constructed from the same material as the inner shell 60. Thus, the selection of the material for the suspension clip 40 is not dependent on preventing electrical conduction.

Figure 7:
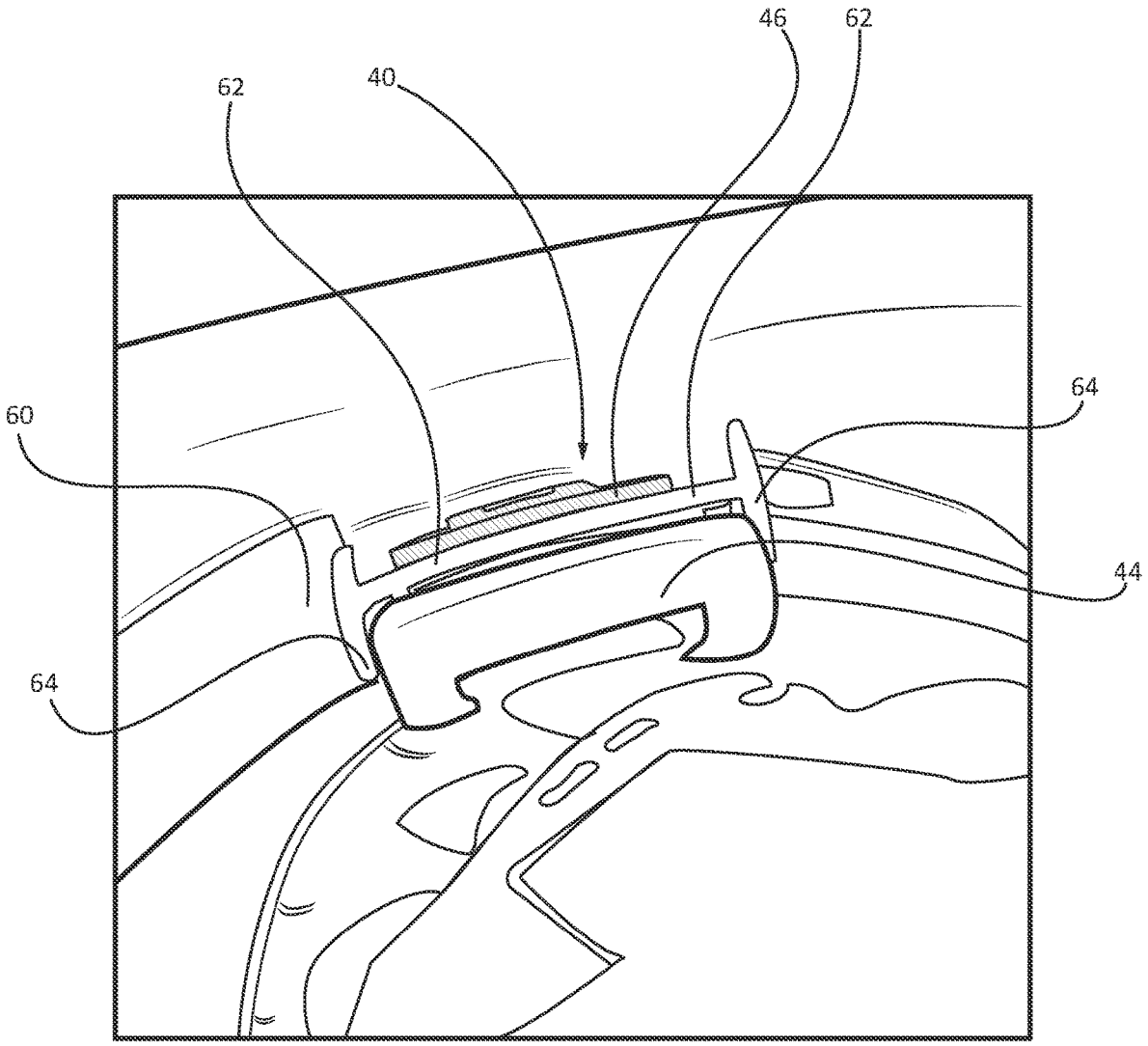
FIG. 7 is a top perspective view of the barrier feature of the helmet of FIG. 1, in accordance with an embodiment of the present invention.

FIG. 7 is a top perspective view of the barrier feature of the helmet of FIG. 1, in accordance with an embodiment of the present invention. The top view of the enlarged suspension clip 40 further shows the barrier 62 with the sidewalls 64, the sidewalls 64 being adjacent the inner shell 60. The barrier 62 is shown positioned directly between the first connecting member 44 and the second connecting member 46. The barrier 62 extends a width of the suspension clip 40. The sidewalls 64 of the barrier 62 directly contact the sidewalls of the first connecting member 44.

The thickness of the barrier 62 can vary per design specifications, and can be, e.g., in one instance, between 0.25 mm to 1.5 mm.

Therefore, in accordance with FIGS. 1-7, a helmet is provided including an outer shell, an inner shell molded within the outer shell, the inner shell supporting a cap with straps and having a barrier wall, and at least one suspension clip coupled to the cap and releasably attached to the barrier wall, the barrier wall separating a distal end of the at least one suspension clip into two components, the two components having a first connecting member and a second connecting member.

The two components include a first connecting member and a second connecting member. The first connecting member is in opposed relation to the second connecting member. Stated differently, the first connecting member engages a first side of the barrier wall and the second connecting member engages a second side of the barrier wall, the first and second sides being in opposed relation to each other. The first and second connecting members are configured to releasably attach underneath the barrier wall such that a top surface of the barrier wall remains exposed.

The barrier wall prevents an electrical conduction between the first and second connecting members. The barrier wall is constructed from a material different than a material of the first and second connecting members. The barrier wall is a part of the inner shell. Moreover, the first connecting member includes a pair of legs extending therefrom, the pair of legs engaging a body of the at least one suspension clip. The barrier wall is confined between a pair of barrier sidewalls such that the first connecting member is adjacent a portion of an inner surface of the pair of barrier sidewalls.

The helmet is a safety helmet formed from a rigid material. The inner shell defines a cavity configured to receive a head of a wearer. The outer shell of the helmet defines a plurality of vents.

In other exemplary embodiments, a helmet is provided including an outer shell, an inner shell positioned within the outer shell to support a cap with straps, and at least one suspension clip having a first connecting member and a second connecting member, the first and second connecting members releasably attached to a barrier wall disposed on the inner shell such that the barrier wall prevents electrical conduction between the first and second connecting members.

Figure 8:
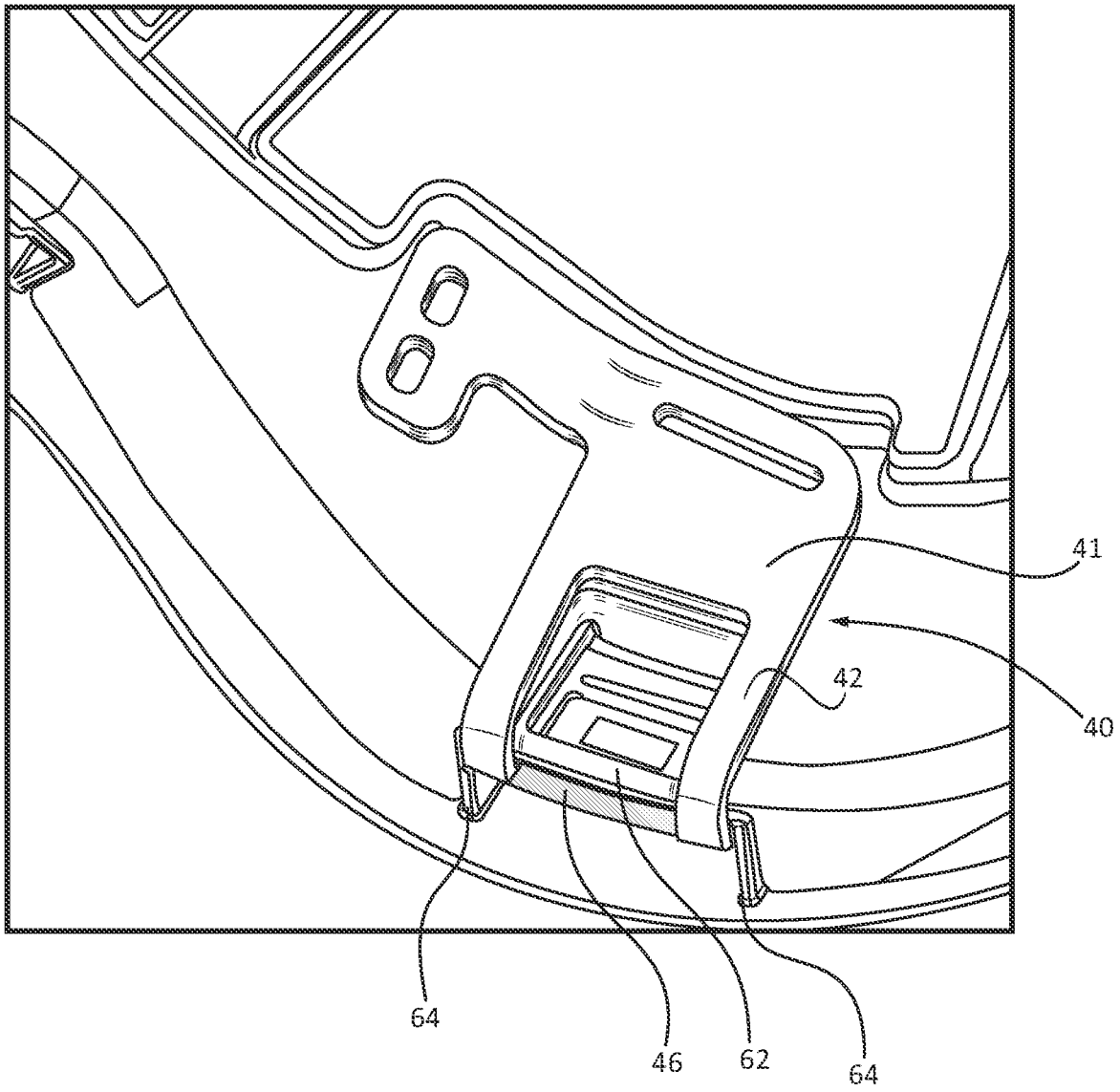
FIG. 8 illustrates a relationship between the suspension clip and the barrier feature of the helmet of FIG. 1, in accordance with an embodiment of the present invention.

FIG. 8 illustrates a relationship between the suspension clip and the barrier feature of the helmet of FIG. 1, in accordance with an embodiment of the present invention. The body 41 of the suspension clip 40 extends along the inner shell 60. The barrier 62 and the sidewalls 64 of the barrier 62 are also shown in relation to the legs 42 of the suspension clip 40.

Figure 9:
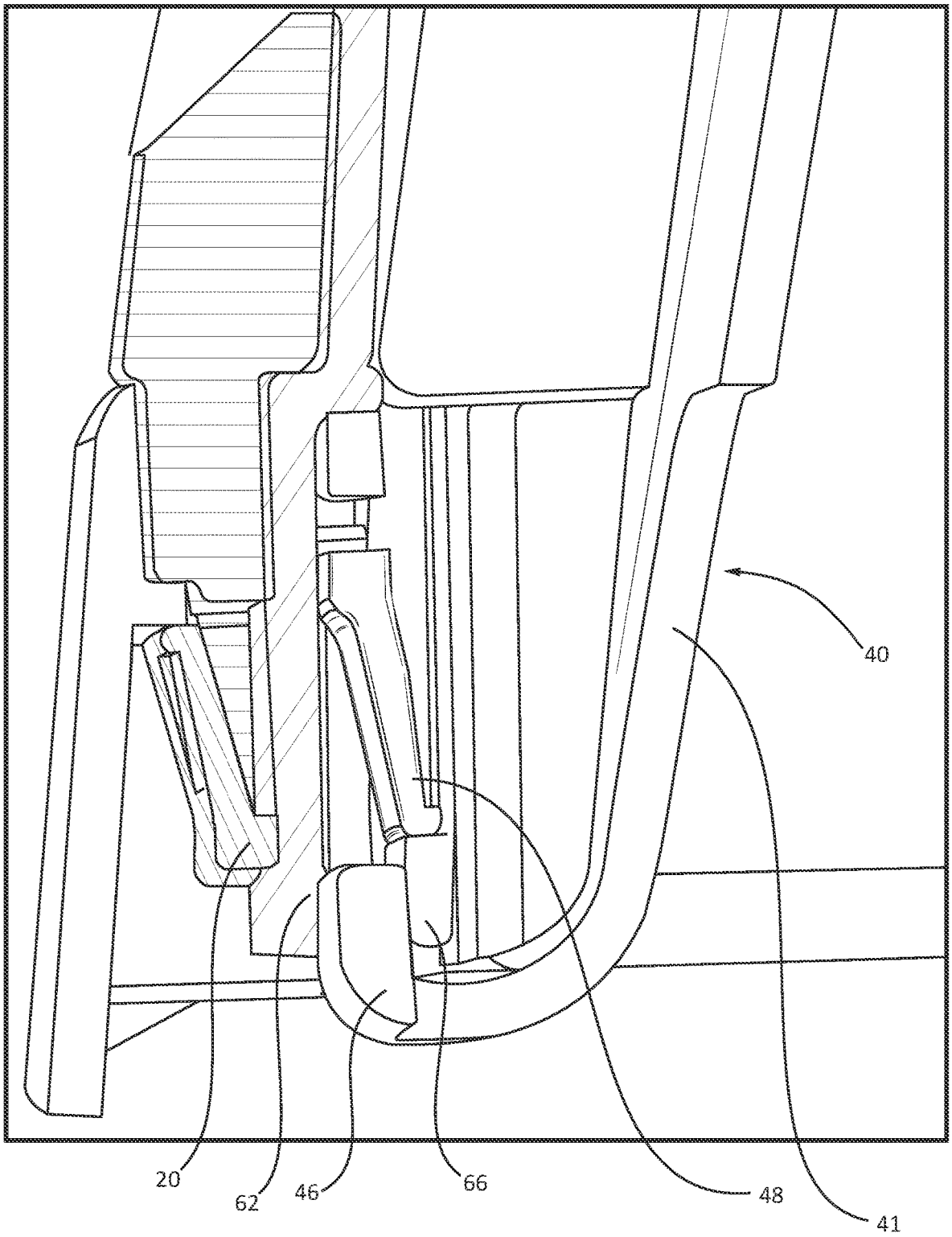
FIG. 9 is a side view of the suspension clip attaching to a cap of the helmet of FIG. 1, in accordance with an embodiment of the present invention.

FIG. 9 is an inner side view of the suspension clip attaching to a cap of the helmet of FIG. 1, in accordance with an embodiment of the present invention. The inner side view shows the body 41 of the suspension clip 40 having a flange 48 extending from the bottom portion 66 of the inner shell 60 to engage the barrier 62. The outer portion 20 of the suspension clip 40 engages the barrier 62 on the outside of the helmet 10. For example, the outer portion 20 of the suspension clip 40 engages the barrier 62 on the left-hand side, whereas the flange 48 engages the barrier 62 on the right-hand side. Therefore, the barrier 62 prevents the suspension clip 40 from being a continuous piece at the distal end thereof. Instead, the barrier 62 separates the outer portion 20 from the flange 48 and body portion 41 of the suspension clip 40 to prevent electrical transmission therebetween.

In summary, the exemplary embodiments of the present invention introduce the barrier 62 that acts as an electrical wall or electrical insulator that operates to prevent the distal end of the suspension clip 40 from being a continuous component. In other words, the distal end of the suspension clip 40 is broken or separated or disconnected by the barrier 62. The barrier 62 thus acts to break any electrical conduction at the distal end of the suspension clip 40. The suspension clip 40 of the exemplary embodiments is not material dependent. Instead, the distal end of the suspension clip 40 is split or divided into two distal pieces or components that are separated or disconnected or insulated by the barrier 62, and can be constructed from the same material as the inner shell 60. Thus, the selection of the material for the suspension clip 40 is not dependent on preventing electrical conduction.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

It should also be understood that the example embodiments disclosed and taught herein are susceptible to numerous and various modifications and alternative forms. Thus, the use of a singular term, such as, but not limited to, "a" and the like, is not intended as limiting of the number of items. Furthermore, the naming conventions for the various components, functions, parameters, thresholds, and other elements used herein are provided as examples, and can be given a different name or label. The use of the term "or" is not limited to exclusive "or" but can also mean "and/or".

Having described preferred embodiments, which serve to illustrate various concepts, structures and techniques that are the subject of this patent, it will now become apparent to those of ordinary skill in the art that other embodiments incorporating these concepts, structures and techniques may be used. Additionally, elements of different embodiments described herein may be combined to form other embodiments not specifically set forth above.

Accordingly, it is submitted that that scope of the patent should not be limited to the described embodiments but rather should be limited only by the spirit and scope of the following claims.

The invention claimed is:

1. A helmet comprising:

an outer shell;

an inner shell molded within the outer shell, the inner shell supporting a cap with straps and having a barrier wall; and at least one suspension clip coupled to the cap and releasably attached to the barrier wall, the barrier wall separating a distal end of the at least one suspension clip into two components, the two components having a first connecting member and a second connecting member.

2. The helmet of claim 1, wherein the first connecting member is in opposed relation to the second connecting member.

3. The helmet of claim 1, wherein the first connecting member engages a first side of the barrier wall and the second connecting member engages a second side of the barrier wall, the first and second sides being in opposed relation to each other.

4. The helmet of claim 1, wherein the first connecting member and the second connecting member are configured to releasably attach underneath the barrier wall such that a top surface of the barrier wall remains exposed.

5. The helmet of claim 1, wherein the barrier wall operates to prevent an electrical conduction between the first connecting member and the second connecting member.

6. The helmet of claim 1, wherein the barrier wall is constructed from a material different than a material of the first connecting member and the second connecting member.

7. The helmet of claim 1, wherein the barrier wall is a part of the inner shell.

8. The helmet of claim 1, wherein the first connecting member includes a pair of legs extending therefrom, the pair of legs engaging a body of the at least one suspension clip.

9. The helmet of claim 1, wherein the barrier wall is confined between a pair of barrier sidewalls.

10. The helmet of claim 9, wherein the first connecting member is positioned adjacent a portion of an inner surface of the pair of barrier sidewalls.

11. The helmet of claim 1, wherein the helmet is a safety helmet formed from a rigid material.

12. The helmet of claim 1, wherein the inner shell defines a cavity configured to receive a head of a wearer.

13. The helmet of claim 1, wherein the outer shell of the helmet defines a plurality of vents.

14. A helmet comprising:

an outer shell;

an inner shell positioned within the outer shell to support a cap with straps; and at least one suspension clip having a first connecting member and a second connecting member, the first connecting member and the second connecting member being releasably attached to a barrier wall disposed on the inner shell such that the barrier wall operates to prevent electrical conduction between the first connecting member and the second connecting member; the barrier wall being constructed from a material different than a material of the first connecting member and the second connecting member.

15. The helmet of claim 14, wherein the first connecting member engages a first side of the barrier wall and the second connecting member engages a second side of the barrier wall, the first and second sides being in opposed relation to each other.

16. The helmet of claim 14, wherein the first connecting member and the second connecting member are configured to releasably attach underneath the barrier wall such that a top surface of the barrier wall remains exposed.

17. The helmet of claim 14, wherein the barrier wall is a part of the inner shell.

18. The helmet of claim 14, wherein the barrier wall is confined between a pair of barrier sidewalls such that the first connecting member is adjacent a portion of an inner surface of the pair of barrier sidewalls.

* * * * *